United States Patent [19]

Silliman

[11] 4,109,255

[45] Aug. 22, 1978

[54] OMNIDIRECTIONAL BROADBAND CIRCULARLY POLARIZED ANTENNA

[76] Inventor: Thomas B. Silliman, 108 Market St., Newburgh, Ind. 47630

[21] Appl. No.: 779,619

[22] Filed: Mar. 21, 1977

[51] Int. Cl.[2] ..... H01Q 1/36

[52] U.S. Cl. ..... 343/853; 343/793; 343/792; 343/908

[58] Field of Search ..... 343/797, 793, 792, 828, 343/908, 853, 726

[56] References Cited

U.S. PATENT DOCUMENTS

| | | | |
|---|---|---|---|
| 2,480,172 | 8/1949 | Willoughby | 343/792 |
| 3,388,400 | 6/1968 | Veldhuis | 343/797 |

*Primary Examiner*—Alfred E. Smith
*Assistant Examiner*—David K. Moore
*Attorney, Agent, or Firm*—Leonard H. King

[57] ABSTRACT

A circularly polarized antenna providing an omnidirectional pattern over an extremely broad band of frequencies. A pair of arcuate dipoles are mounted at an angle relative to each other and at about 45° to the horizontal plane and fed 180° out of phase from a common feed. The feed lines and feed points are completely enclosed.

5 Claims, 4 Drawing Figures

OMNIDIRECTIONAL BROADBAND CIRCULARLY POLARIZED ANTENNA

This invention relates to omnidirectional broadband circularly polarized antennas.

BACKGROUND OF THE INVENTION

In the transmission of radio signals such as in FM broadcasting, there is a requirement for an antenna which is omnidirectional in pattern and which presents a low VSWR to the feed line and transmitter over a broad band of frequencies.

It is well known that a combination of vertical and horizontal polarization (with respect to some reference plane, e.g., the earth's surface) will result in circular or elliptical polarization of radiation, depending upon the relative phase and amplitude relationship. Vertically polarized radiation may be obtained from a vertical antenna such as a vertically oriented dipole; horizontally polarized radiation may be obtained from a horizontal antenna such as a horizontally oriented dipole or loop. The loop may be bent into a complete circle, or be peripherally incomplete with the open ends of the semicircular conductors being connected together electrically by capacitance plates. Either loop form has a toroidal radiation pattern polarized in the plane of the omnidirectional pattern and of the loop. A vertical dipole has the same radiation pattern but polarized transverse to the plane of the omnidirectional pattern.

It has been suggested in the literature that these two antenna types with identical radiation patterns when orthogonally polarized be combined to form a circularly polarized antenna, omnidirectional in one plane, usually the horizontal plane. To do this, it is necessary to so locate the loop and dipole that their phase centers are essentially coincident and then to feed the two with equal signal, and 90° phase difference. This arrangement is difficult to achieve.

In the past FM transmitting antennas having a VSWR of 1.5:1 over a bandwidth of ±1% of the frequency of interest has been regarded as reasonable. Thus, for the FM band (88–108 mc) the VSWR would be under 1.5:1 for a band of about 2 mc.

In Richard D. Bogner U.S. Pat. No. 3,474,452 issued Oct. 21, 1969, and assigned to the assignee of the present application, it has been disclosed that it is possible to obtain an omnidirectional circularly polarized antenna from a combination of a horizontally polarized loop with vertically polarized elements affixed to each end of the loop. Similarly, a loop can be bent into helical section which will produce a circularly polarized omnidirectional pattern. However, such a structure generally results in a VSWR in the order of 1.5:1 over the aforedefined "resonable" bandwidth. If the loop is opened up into an arc of much larger diameter, such as about 30 inches diameter at 100 mHz, for example, the bandwidth will be increased by an order of about 5:1. However, an unacceptable radiation pattern results.

It is desirable, however, that a broad bandwidth be achievable with low VSWR. If the bandwidth is in the order of 10 mHz in the FM band, a single antenna may be employed for the simultaneous radiation of several channels. This is accomplished by feeding the output of several transmitters through suitable filters to a single antenna. Further, a broad band antenna is less susceptable to the deleterous effects of ice formation or the effects of tower proximity. Another advantage is that only a few designs are necessary to provide antennas covering the entire FM band of 88 to 108 mHz, thus simplifying the manufacturing process.

The antenna of this invention employs a pair of helical dipole loops positioned at an angle relative to each other and fed 180° out of phase with each other. The antenna exhibits broader bandwidth and a radiation pattern of better circularity than that obtainable with a single loop antenna. By forming the loop of tubing of large cross-sectional diameter as for example of 3 $\frac{1}{8}$ inches tubing as employed for coaxial transmission line, the broad bandwidth characteristic is maintained.

A feature of the invention is that the antenna is fed entirely from circuitry contained within the antenna element itself, leaving exposed to the elements only two insulated sleeves; or, in an alternative embodiment, through the use of a balun, four insulated sleeves. Accordingly, it is an object of this invention to provide an antenna which has broad bandwidth with low VSWR and which has a radiation pattern of better circularity than that obtainable with a single loop.

An additional feature of the invention is that an approximately one-fourth wave long, horizontal supporting section is available in which a matching section may be placed to transform the single element feed impedance up from the single bay self-impedance of approximately 50 ohms, to N times 50 ohms, where N is the number of elements above or below the feed point thus facilitating feeding of an array from a standard 50 ohm transmission line.

If it were desired to employ a different impedance line, say of 25 ohm characteristic impedance, then the impedance of the dipole elements and/or the transformer would be adjusted accordingly.

As will be discussed more fully hereinafter, the low operating Q of the antenna in conjunction with its braod bandwidth allow it to be operated with an unusually high input power per bay, typically 40 kilowatts per bay.

A most important further feature of this antenna is that the broad bandwidth and sleeve protected feed make it highly impervious to icing, so that it may be used in moderate icing areas without the addition of thermal deicing or the addition of protective radomes. For instance, radomes in high icing areas are often subject to severe damage from falling ice. This feature leads, in turn, to a considerable simplification in maintenance.

The extremely wide operational bandwidth of this antenna coupled with the extremely high per bay power handling capability makes it suitable for multi-station use, provided that suitable combining filters are employed.

The above description, as well as further objects, features and advantages of the present invention will be more fully appreciated by reference to the following detailed description of a presently preferred, but nonetheless illustrative, embodiment in accordance with the present invention when taken in conjunction with the accompanying drawings. In the Drawings:

FIG. 1 is a perspective showing of a single bay of the antenna of this invention;

FIG. 2A and 2B comprise an exploded plan view of the antenna shown partially sectioned; and FIG. 3 is a section taken along lines 3—3 of FIG. 2A.

DESCRIPTION OF THE PREFERRED EMBODIMENT

Figure 1:
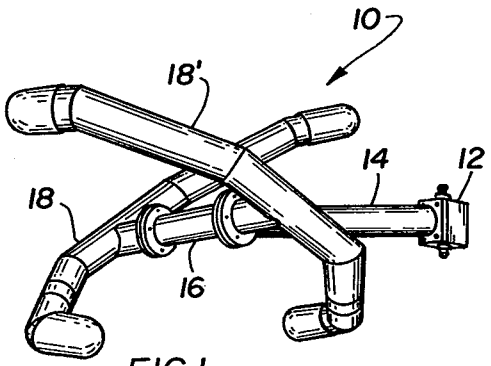

Referring now to FIG. 1 there is shown a typical antenna bay 10 of this invention. A line block 12 is utilized for attachment to a coaxial transmission line. Coaxial line 14 joins the line block 12 to a coaxial tee 16 joining a pair of half-loops 18, 18'. A number of such bays may be joined one above the other by coaxial lines to form an array.

In one embodiment of the invention the assembly is fabricated from standard 3 ⅛ inches OD copper or brass tubing. In order to achieve a loop shape without the necessity of bending this large diameter tubing, it is fabricated from a number of sections, which are mitred and brazed together. The sections thereof are designated 20*a*, 20*b*, 20*c*, 20*d*, 20*e*, 20*f*, 20*g*. 20*a* and 20*b* are end sections over which are fixed metal caps 22, which are dimensioned so that they may slide over the tubing. Members 22, as will be explained later, are intended to slide back and forth over the end section and then be locked in place as part of the tuning operation performed on the antenna.

Members 22 terminate in half corona balls 23, which serve to minimize the possibility of corona discharge. Partition 24 is brazed across member 20c and serves to seal off the active portion of the loop.

Figures 2A, 3:
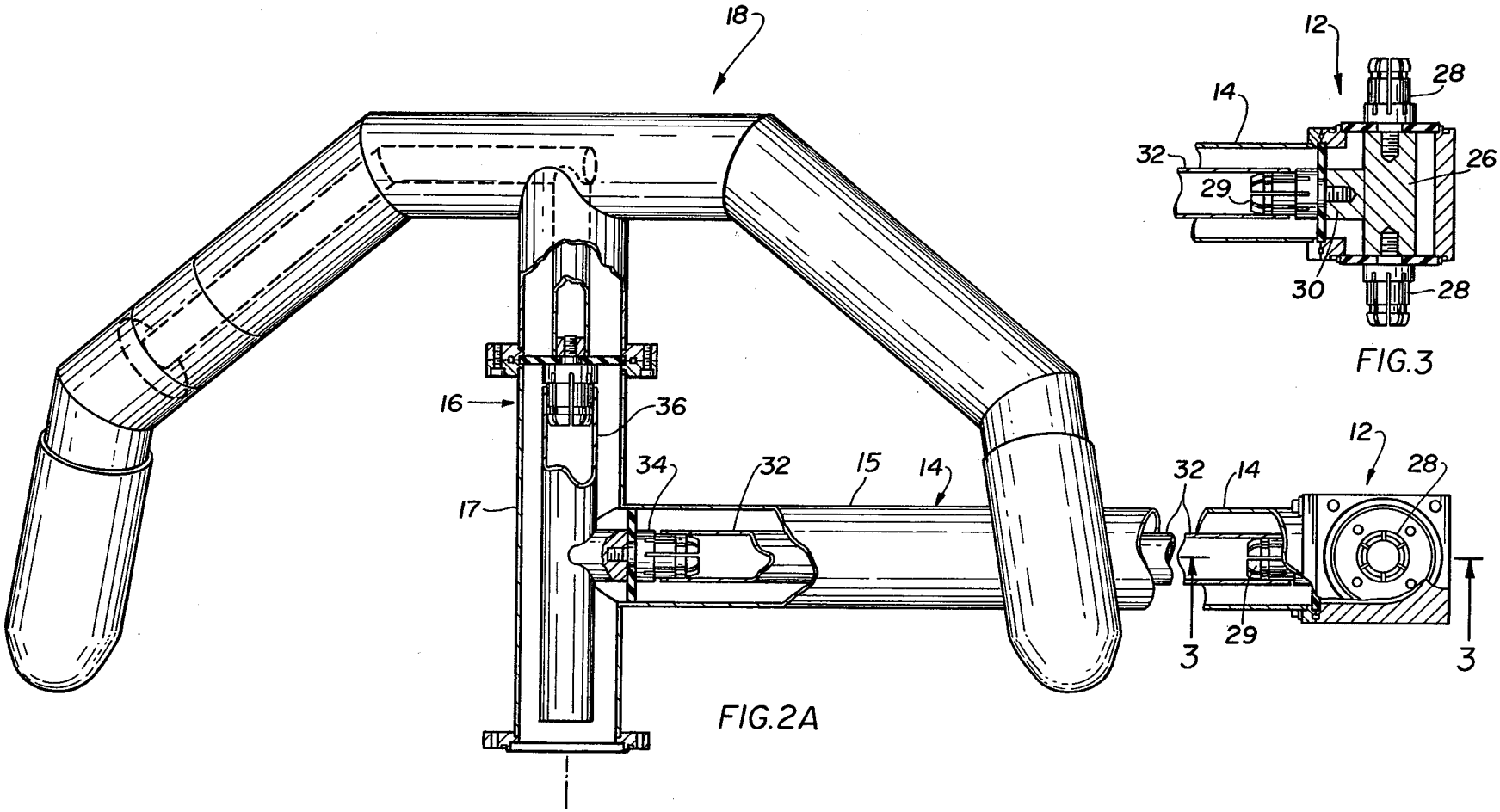

Referring now to FIG. 3, there is shown line block 12 containing therein a tee member 26 to which are secured captive bullets 28. As is well known in the art, the captive bullets make connection to the center conductor of the connecting coaxial line and flanges on the adjacent section of the coaxial line bolt to the line block 12. Member 30 serves to tap off from tee 26 and connects with another captive bullet 29, which mates with center conductor 32 of member 14.

Figure 2B:
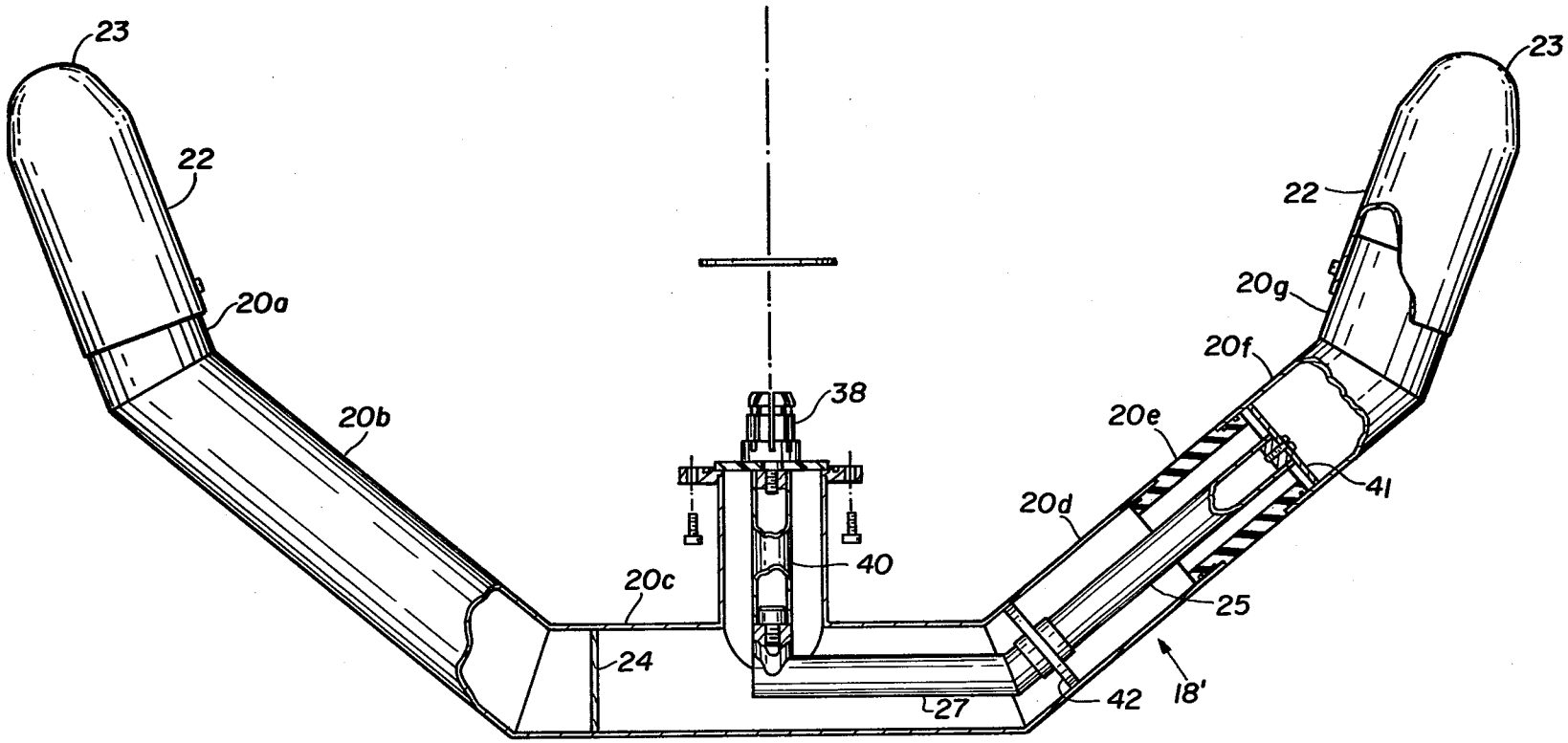

Referring now to FIG. 2A, it will be noted that the other end of the center conductor 32 is connected to a block 34 which connects with cross bar 36 of member 16. The outer conductor 15 of member 14 is connected to outer conductor 17 of member 16. In turn, connection is made to half-loop radiators 18 and 18'. Referring now to FIG. 2B, it will be seen that the loop 18' is provided with a captive bullet 38, which connects to a center conductor 40, which, in turn, is coupled to an inner conductor 27 which, in turn, is connected to inner conductor 25. Member 25 terminates and is coupled to a plate 41, secured to member 20*f*, both electrically and mechanically. It will be noted that member 20*e* is a melamine insulator which isolates section 20*d* from 20*f*. Member 42 is a Teflon support.

From the foregoing, it will be appreciated that the feed point is fully gasketed and never exposed to the elements. The melamine insulator is cemented in place by a suitable sealant. Such sealants are commonly used in the electronics industry.

It will be noted that the radiating elements are so located as to be at the bottom of the antenna with a non-radiating end upwardly. This has the advantage that in the event of a lightning strike, the possibility of damage to the conducting portions are greatly minimized. Further, the elements are now being fed 180° out of phase.

In designing the elements the inner conductors are so selected that for one bay the impedance of the element would be 50 ohms, thus allowing the use of an input power equivalent to the maximum line rating of the transmission line. However, for applications involving arrays of a plurality of elements, in order to achieve a 50 ohm input impedance for the array, the section of the inner conductor 32 which extends between the line block and member 36, is replaced by a transforming inner conductor so selected that it will transform the impedance of the feed point between the two elements to an impedance equal to the number of bays times 50 ohms at the short point. Thus, for example, with a six bay antenna the impedance of each of the antenna bays would be transformed to appear as 300 ohms. Accordingly, with six antenna bays fed from a single transmission line, the line impedance at the input to the array of antennas will be 50 ohms.

This arrangement permits simplified tuning of the antennas. The array would be arranged on a suitable support and the end caps 23 varied in their position until the elements, per se, are resonant at the desired frequency. A fine tuner connected to the array is then adjusted to minimize the VSWR. The resultant radiated signal, eminating from this antenna, is circularly polarized.

The half-loop radiators are each about $\lambda/2$ in length, where $\lambda$ is the frequency of interest.

The antenna of this invention is of inherently low Q, has broad bandwidth and can handle high power.

It will be recognized from the foregoing description that an array will appear as a plurality of half-loops forming a disjointed intertwined right hand and left hand helices fitting within a circumscribing cylinder.

While there have been shown and described and pointed out the fundamental novel features of the invention as applied to a preferred embodiment thereof, it will be understood that various omissions and substitutions and changes in the form and details of the device illustrated and in its operation may be made by those skilled in the art without departing from the spirit of the invention. It is the intention, therefore, to be limited only as indicated by the scope of the claims appended hereto.

What is claimed is:

1. A circularly polarized antenna comprising a first arcuate half loop radiating element approximately $\lambda/2$ in length;

a second arcuate half loop radiating element approximately $\lambda/2$ in length; each of said radiating elements consisting of a long hollow electrically conductive member and a short hollow electrically conductive member isolated from each other by an insulator;

radiating element coaxial feed line means within each said long conductive member having a center conductor electrically connected to said short conductive member;

said half loops positioned with their mid points opposite each other and the ends of the half loops oriented inwardly relative to a circumscribing cylinder, the plane of said half loops being at an angle to each other; and means for feeding said center conductors 180° out of phase.

2. The antenna of claim 1 having means to adjustably vary the length of said half loop.

3. The antenna of claim 1 including a further coaxial transmission line joining both said radiating element coaxial feed lines and a coaxial tee connection extending from said further coaxial transmission line and means to energize said coaxial tee connection.

4. The antenna of claim 3 wherein said coaxial tee connection is a matching transformer.

5. The antenna of claim 1 wherein said coaxial tee connection terminates in a line block adapted to be coupled by means of a transmission line to a signal source.

* * * * *